US008844188B2

(12) United States Patent
Erdoss et al.

(10) Patent No.: US 8,844,188 B2
(45) Date of Patent: Sep. 30, 2014

(54) OCULAR CROSS DOMINANCE IMPEDIMENT CORRECTIVE APPARATUS FOR USE WITH A SHOULDER-MOUNTED FIREARM

(71) Applicants: Andrei Erdoss, Austell, GA (US); Vasile Erdoss, Austell, GA (US)

(72) Inventors: Andrei Erdoss, Austell, GA (US); Vasile Erdoss, Austell, GA (US)

( * ) Notice: Subject to any disclaimer, the term of this patent is extended or adjusted under 35 U.S.C. 154(b) by 0 days.

(21) Appl. No.: 13/934,168

(22) Filed: Jul. 2, 2013

(65) Prior Publication Data

US 2014/0007484 A1 Jan. 9, 2014

Related U.S. Application Data

(60) Provisional application No. 61/667,525, filed on Jul. 3, 2012.

(51) Int. Cl.
*F41G 3/00* (2006.01)
*F41G 11/00* (2006.01)

(52) U.S. Cl.
CPC ..... *F41G 3/005* (2013.01); *F41G 11/00* (2013.01)
USPC ..... 42/111

(58) Field of Classification Search
CPC ..... F41G 3/005; F41G 3/26; F41G 11/00
USPC ..... 42/111, 138, 140, 141, 143, 148, 90, 42/106; D22/108, 109
See application file for complete search history.

(56) References Cited

U.S. PATENT DOCUMENTS

| | | | | | |
|---|---|---|---|---|---|
| 40,256 | A | * | 10/1863 | Garretson | 42/111 |
| 309,342 | A | * | 12/1884 | Gilbert | 42/111 |
| 621,066 | A | * | 3/1899 | Gilbert-Russell | 42/138 |
| 1,320,888 | A | * | 11/1919 | Miller et al. | 89/36.06 |
| 2,306,708 | A | * | 12/1942 | Mendel | 42/106 |
| 2,313,608 | A | * | 3/1943 | Wiles | 42/1.01 |
| 2,442,215 | A | * | 5/1948 | Shy | 42/148 |
| 4,159,575 | A | * | 7/1979 | Kalmbach | 33/265 |
| 4,418,487 | A | * | 12/1983 | Strahan | 42/125 |
| 4,815,822 | A | * | 3/1989 | Bramhall | 359/601 |
| 5,435,293 | A | * | 7/1995 | Grimaldi | 124/87 |
| 5,566,489 | A | * | 10/1996 | Artman et al. | 42/83 |
| 5,590,486 | A | * | 1/1997 | Moore | 42/114 |
| D406,304 | S | * | 3/1999 | Elliott | D22/108 |
| 6,226,880 | B1 | * | 5/2001 | Pitre | 42/120 |
| D674,035 | S | * | 1/2013 | Conroy | D22/109 |
| 2003/0140544 | A1 | * | 7/2003 | Thibodeaux | 42/111 |
| 2006/0265928 | A1 | * | 11/2006 | Arachequesne | 42/111 |
| 2007/0130817 | A1 | * | 6/2007 | Ballard | 42/118 |
| 2008/0034637 | A1 | * | 2/2008 | Summers | 42/111 |

(Continued)

*Primary Examiner* — Bret Hayes
(74) *Attorney, Agent, or Firm* — Andrei Erdoss; Vasile Erdoss

(57) ABSTRACT

A device for sighting a distant moving target by a shooter using a shoulder-mounted firearm provided with a trigger guard disposed around the trigger as a strip of metal or other suitable material. The device is comprised of a horizontal mounting base, a vertical support member, and a small screen or blade. The mounting base includes a mechanism for releasably fixing it in place, and a pair of parallel arms extending from a common origin which sandwich a section of the trigger guard when mounted. The support member extends vertically from the base so as to support the small screen adjacently to a side of the firearm. When the shooter mounts the firearm, the screen protrudes into the sightline of the eye opposite to the mounting shoulder thus concealing the barrel while allowing that opposite eye to see the target at all time.

1 Claim, 3 Drawing Sheets

(56) References Cited

U.S. PATENT DOCUMENTS

2010/0307047 A1* 12/2010 Long ..... 42/119
2012/0060402 A1* 3/2012 Dueck ..... 42/137
2013/0036650 A1* 2/2013 Larue ..... 42/148
2013/0174819 A1* 7/2013 Arajakis ..... 124/23.1
2013/0203019 A1* 8/2013 Nolen ..... 434/16

* cited by examiner

OCULAR CROSS DOMINANCE IMPEDIMENT CORRECTIVE APPARATUS FOR USE WITH A SHOULDER-MOUNTED FIREARM

CROSS-REFERENCE TO RELATED APPLICATION

This application claims the benefit of provisional patent application Ser. No. 61/667,525 filed Jul. 3, 2012 by Andrei Erdoss and Vasile Erdoss.

BACKGROUND

This relates to shotguns, or any shoulder-mounted firearms, and shooters who have ocular cross dominance. For simplicity, I will refer to all shoulder-mounted firearms as shotguns throughout this document.

Ocular dominance, sometimes referred to as eyedness, is a natural phenomenon in which the brain prefers visual input from one eye over the other. Generally, people have their dominant eye on the side of their dominant hand. A fraction of the population, however, are cross dominant, which means that their dominant eye is on the side of their non dominant hand. For example, a right-handed person with ocular cross dominance will have their left eye as dominant.

Ocular dominance has also been classified as weak or strong, and the Hubel-Wiesel 7 point scale is such a means for classification (Calabrese). The value 1 on the scale represents strong cross dominance, 7 represents strong regular dominance, and 4 is the middle value meaning that neither eye is dominant. This demonstrates that people experience cross dominance, on a spectrum and not as a definite fact.

Eye dominance goes unnoticed in most human activities, but cross dominance has been noted as a problem in activities which require aim, such as shooting sports. In day shooting, a regular dominance person mounts a shotgun on the side of the dominant hand and uses the dominant eye to look along the top of the barrel in order to relate it to a moving target. A person with cross dominance also needs to mount the shotgun on the side of the dominant hand in order to comfortably shoot it. In this stance, the shooter will see an incorrect image of the barrel, because the preferred visual input comes from the cross dominant eye which is located beside the barrel. Thus, the shooter will see the side of the barrel which will look shifted to the left or right relative to its real location. This poses some problems, especially when shooting at moving targets.

When shooting at moving targets, the shooter must relate the gun to a target by focusing on it with both eyes, pivoting the shotgun according to its speed and trajectory, and then accelerating the gun movement so as to shoot ahead. As described before, cross dominant shooters cannot see the barrel correctly when the shotgun is mounted on their handedness side. This makes it very difficult for them to judge the real location of the barrel and, thus, relate it to the target accurately. Obviously, not knowing where their shotgun is pointing decreases their performance and, eventually, their self confidence.

Another vision issue in shooting is the sight of a double image, or ghost image, of the barrel while looking with both eyes at a target in the distance. The phenomenon is generally caused by normal stereoscopic vision (Wang, 1999), but the double image may appear stronger depending on how weak the shooter's ocular dominance is. Seeing a strong double image of the barrel can confuse him or her about its correct position making it difficult to relate to the target correctly.

BACKGROUND

Prior Art

The following is a tabulation of some prior art that presently appears relevant:

| U.S. Pat. No. | Filing Date | Issue Date | Applicant |
|---|---|---|---|
| 4,761,196 | Jan. 2, 1987 | Aug. 2, 1988 | Brown, et al. |
| 7,147,320 | Apr. 15, 2005 | Dec. 12, 2006 | Werner |
| 5,373,657 | Nov. 19, 1993 | Dec. 20, 1994 | Betz, et al. |
| 309,342 | Feb. 27, 1884 | Dec. 16, 1884 | Thomas Gilbert |
| 621,066 | Dec. 23, 1897 | Mar. 14, 1899 | Thomas Gilbert-Russell |

NONPATENT LITERATURE

Calabrese, Ana. "Ocular Dominance Column." *Scholarpedia*, no 4 (3):2668. doi:10.4249/scholarpedia.2668. Accessed Jul. 1, 2013 http://www.scholarpedia.org/article/Ocular_dominance "Eyestrain", Mayo Clinic staff, *Mayo Clinic*, last modified Sep. 9, 2012, http://www.mayoclinic.com/health/eyestrain/DS01084

Wang, Ruye. "Stereoptical Vision and Depth Perception," last modified Oct. 11, 1999 http://fourier.eng.hmc.edu/e180/lectures/depth/node4.html Shooters have used a type of prior art, colloquially known as "blinders." They are made of various opaque materials and placed usually on the shooting glasses to cover the cross dominant eye. Their goal is to alleviate the effects of cross dominance by blocking the dominant eye from the shooting action. This is a problem because binocular vision is very important for correctly perceiving the depth, angle, and speed of moving targets. Shooting with one eye covered greatly reduces the performance of a shooter.

Eyestrain is another negative effect of blinders. The non dominant eye becomes strained because it is forced to focus on the target alone. Thus, the shooter begins to feel symptoms of eyestrain (Eyestrain, 2012), such as discomfort, fatigue, and headaches.

U.S. Pat. No. 4,761,196 to Brown (1988) and U.S. Pat. No. 7,147,320 to Werner (2005) are examples of such blinders. Brown's invention is a method of using a semi transparent disc of approximately the size of the eye's iris, which is placed on a shooter's glasses so that its axis coincides with the visual axis of the eye. The disk blocks vision though the eye due to its proximity, leaving the non dominant eye to focus on the targets alone. This is undesirable because, as mentioned before, seeing a moving target with both eyes is crucial for achieving good shooting performance. Also, Brown's method becomes ineffective for targets moving at very sharp angles because the cross dominant eye can see around the disk. Furthermore, taking into account that one round of clay shooting has on average at least twenty five to fifty targets or that bird hunting requires hours of concentration, the non dominant eye becomes strained and the shooter experiences discomfort and headaches.

U.S. Pat. No. 7,147,320 to Werner (2005) describes a device mounted on prescription or shooting glasses that also covers the cross dominant eye. Even more, the patent states, beginning with the title, that the device eliminates peripheral vision. This means that the user of Werner's device will have a delayed reaction to all of the targets that are usually first seen with peripheral vision, such as targets moving in from the side. This kind of limitation is unnecessary and unacceptable for achieving good shooting performance.

Betz, in U.S. Pat. No. 5,373,657, uses a different approach in trying to correct the problem of ocular cross dominance. He designed an apparatus positioned on the rib of a shotgun, close to the aiming bead. The device is meant to help the non dominant eye to focus better on the barrel, which is only acceptable for shooting at fixed targets. As stated before, for moving targets, the shooter needs to focus both eyes on the target, not the gun. Furthermore, with Betz's device, the cross dominant eye can still form that displaced side view of the barrel described earlier. This happens because Betz's device does not prevent the cross dominant eye from relating the shotgun to the target and, thus, leading the shooting process.

My device also relates to U.S. Pat. No. 309,342 from December 1884, to Thomas Gilbert. The screen or blade of Gilbert's device is supported in place by a stud or bolt that passes through the stock and lock of the firearm. Gilbert's device was devised for older generation shotguns which had a manual cocking system and which are currently rare on the market. Moreover, his attachment method requires the user to drill through the body of the shotgun, permanently affecting its build and aesthetics. Such alterations diminish its value and make it very difficult to resell. Furthermore, drilling the same way through a modern shotgun would interfere with its functioning, not to mention that such an action would require expert handling to be accomplished safely. Most importantly, Gilbert's invention is fixed and non adjustable to the different morphological needs of shooters, such as different distances between the eyes.

U.S. Pat. No. 621,066 to Thomas Gilbert-Russell describes an invention based on the one by Thomas Gilbert, but claims to provide improvements to the attachment mechanism so as to make it more adjustable. Each embodiment, described in the patent, is specific to three rifle models and a double barrel side-by-side shotgun, respectively, which are either rare or absent from the current market. Also, each of these variants requires some form of drilling into the body of the shotgun either to insert the base of the device or the screws that hold the base in place. Thus, because it requires permanent alterations to the body of the shotgun, like Gilbert's device, it damages the resale value. Furthermore, the risk, the complexity, and the permanent nature of attaching the invention to a shotgun, coupled with its absence from the current commercial mark demonstrates that it is not commercially viable.

In conclusion, insofar as I am aware, no product or practice formerly developed alleviates the problem of ocular cross dominance when shooting at moving targets without suffering from disadvantages such as:

(a) They block vision through the dominant eye, which compromises the accuracy of depth, speed, and angle perception of the target.
(b) They do not work effectively for all types of target presentations.
(c) They strain the non dominant eye leading to discomfort, fatigue, and headaches.
(d) They eliminate peripheral vision, which the shooter needs in order to establish the shotgun target relation faster.
(e) They do not prevent the cross dominant eye from leading the establishment of the shotgun-target relation.
(f) They make the eyes focus on the barrel as if aiming at a fixed target.
(g) They are impracticable due to the complexity, risk, and cost associated with attaching them to current models of shotguns.
(h) They are not adjustable to the morphological needs of different shooters.
(i) They are inaccessible to a large segment of the total potential market because they are designed for old model shotguns and rifles which are now rare or off the market.

SUMMARY

In accordance with one embodiment, a sight device that attaches to the midsection of a shoulder-mounted firearm to help individuals with ocular cross dominance shoot at moving or fixed targets from their handedness side while maintaining binocular view of the target during the entire shooting process.

ADVANTAGES

Accordingly, several advantages of one or more aspects are as follows: to provide a device that helps improve shooting performance for shooters with ocular cross dominance, that allows for binocular view of the target during the entire shooting process, that does not cause eyestrain, that does not eliminate peripheral vision, that prevents the cross dominant eye from leading the shooting process, that is easy to attach or remove from the shotgun, that is safe to use, that does not require permanent alterations to the shotgun, that can be used on all shotgun models, that can be adjusted for the different morphological needs of shooters, that can be marketed. All of these advantages, and possibly others, will become apparent from a study of the following description and the accompanying drawings.

DRAWINGS

Figure 1:
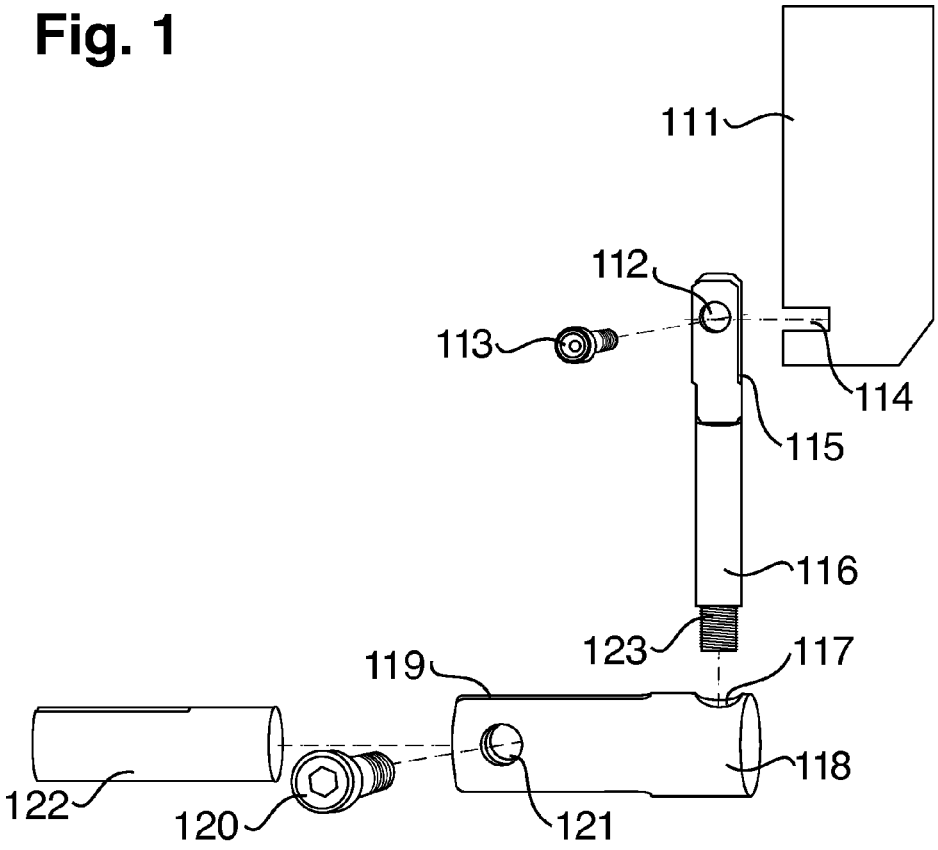
FIG. 1 is an exploded rendering of the device showing individual components and their relation to each other.

| DRAWINGS-REFERENCE NUMERALS | |
|---|---|
| 111 | semitransparent blade |
| 112 | holes of fastening slit 115 |
| 113 | screw for fastening slit 115 |
| 114 | blade hole |
| 115 | fastening slit |
| 116 | support rod |
| 117 | threaded hole |
| 118 | base |
| 119 | fastening slit of base |
| 120 | screw for fastening slit 119 |
| 121 | threaded hole for screw 120 |
| 122 | plastic cylinder |
| 123 | threaded male part |
| 311 | shotgun |
| 312 | trigger guard |

-continued

| DRAWINGS-REFERENCE NUMERALS | |
|---|---|
| 411 | side of shotgun |
| 412 | underside of shotgun |
| 413 | axis of base |
| 414 | alignment line |
| 511 | cross dominant eye |
| 512 | barrel of shotgun |
| 513 | bead of shotgun |

DETAILED DESCRIPTION

FIGS. 1 to 5

First Embodiment

One embodiment of the device is illustrated in FIG. 1, but other embodiments may be possible. In FIG. 1, the device is presented in an exploded rendering showing its components and their relation to each other.

Semitransparent blade 111 is held vertical by support rod 116. Blade 111 mounts onto rod 116 by sliding its edge into fastening slit 115 so as to align blade hole 114 with holes 112. Holes 112 correspond and pierce both arms of fastening slit 115. Screw 113 is inserted through aligned holes 112 and 114, and tightened so as to press the arms of slit 115 together, tightly sandwiching blade 111 between them. Fastened into slit 115, the edge of blade 111 forms a straight line with support rod 116.

Support rod 116 is provided with threaded male part 123 on the opposite end from slit 115. Threaded end 123 fastens into threaded hole 117 so as to fix rod 116 vertically into base 118.

Figure 2:
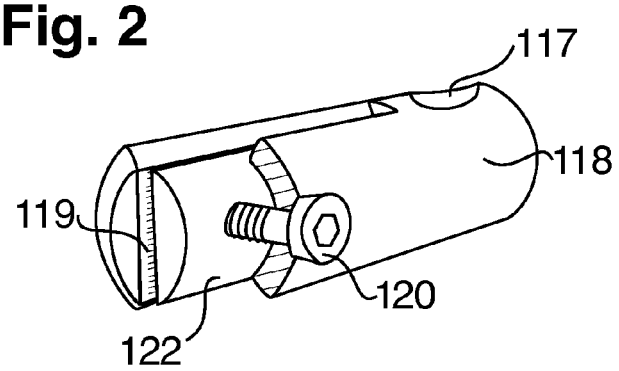
FIG. 2 is an enlarged perspective view of the base of the device. Part of the base is sectioned off so as to show an interior component.

Base 118 is cylindrical and consists of a metal cover and a solid interior piece represented by plastic cylinder 122. The metal cover is capped on one end and open on the opposite end where slit 119 is cut out longitudinally. Slit 119 is carved both into the metal cover and into plastic cylinder 122, as shown in FIG. 2.

Figure 3:
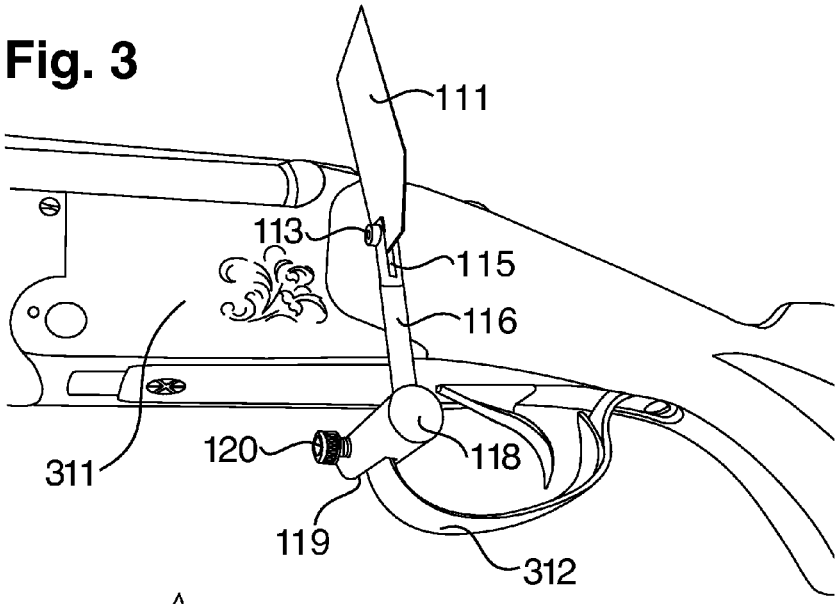
FIG. 3 is a perspective side-view of the device mounted on the left side of a shotgun's trigger guard.

FIG. 3 shows the placement of the device toward the front of trigger guard 312 close to the underside of shotgun 311, which is partially shown. The device attaches to shotgun 311 by sliding slit 119 onto trigger guard 312 perpendicularly. With trigger guard 312 sandwiched between the arms of slit 119, screw 120 is inserted into threaded hole 121 and tightened with a twisting movement. As screw 120 penetrates hole 121, it presses the adjacent plastic arm of slit 119 (FIG. 2) tightening it against the trigger guard and against the other plastic arm.

It is notable that screw 120 does not pierce through the plastic arm it presses. Also, both metal arms of slit 119 are provided with a hole 121 so that the device can easily be mounted on either side of shotgun 311.

Figure 4:
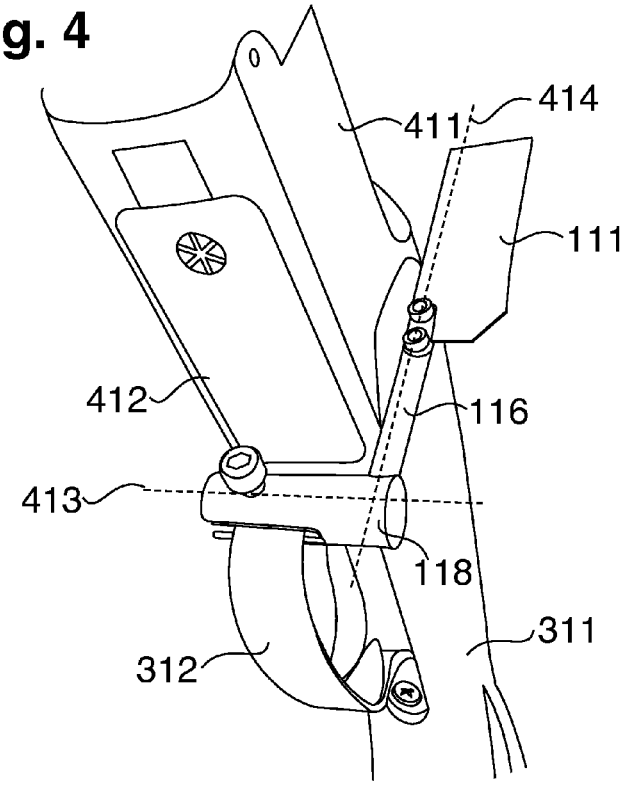
FIG. 4 is a perspective under-view of the device mounted on the left side of the trigger guard.

FIG. 4 demonstrates how the components of the device align with the body of shotgun 311. As in FIG. 3, the shotgun is only partially shown. From this perspective underview, the reader can see that axis 413 of base 118 is parallel to underside 412. Also, support rod 116 and blade 111 align as shown by alignment line 414, which is parallel to side 411 and perpendicular to axis 413. For the proper functioning of the device, rod 116 and blade 111 are adjacent to side 411.

Figure 5:
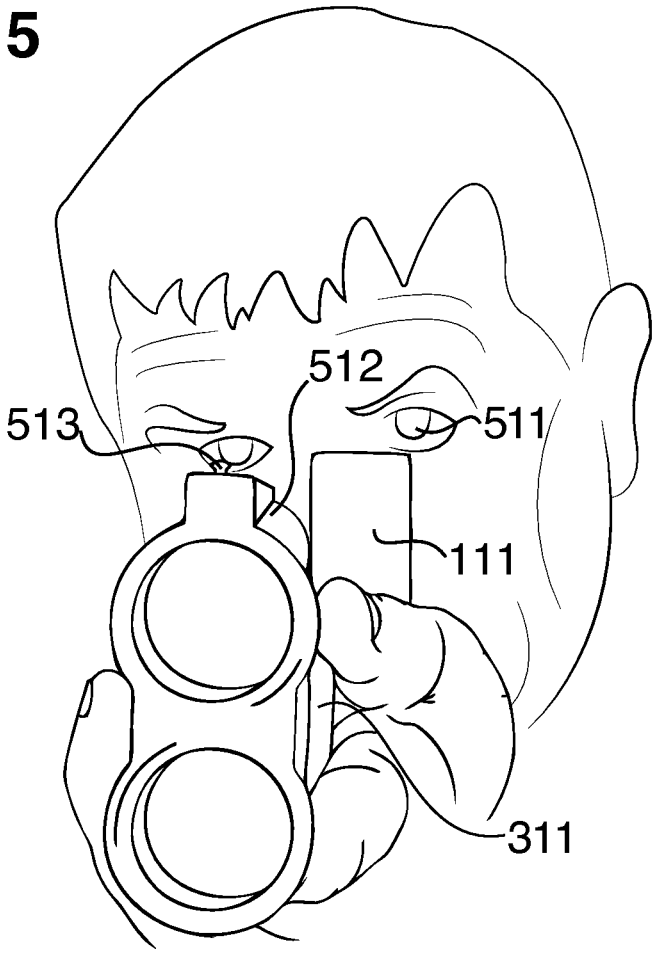
FIG. 5 is a frontal-view of a shooter mounting a shotgun with the device attached to it. This view shows how the semitransparent blade of the device relates to the cross dominant eye of the shooter.

FIG. 5 presents a frontal-view of a right handed shooter shouldering shotgun 311 with the device attached. The shooter has left eye 511 as cross dominant. The only visible part of the device is semitransparent blade 111, located adjacently to the side of shotgun 311. As stated before, the purpose of blade 111 is to prevent eye 511 from seeing barrel 512 and aiming bead 513 while allowing it to see the target at all time. This function is possible due to the proximity of blade 111 to the body of shotgun 311, its size, its distance from the face, and its placement approximately between the eyes of the shooter. Eye 511 can see the target during the whole shooting process because blade 111 does not cover it.

Operation

FIGS. 1 to 5

Before shooting, the shooter mounts the device on trigger guard 312 of shotgun 311 as shown in FIG. 3. For a shooter who is right handed and left eye dominant, the device will be placed such that semitransparent blade 111 is on the left side of the shotgun. If the shooter is using the device for the first time, she will mount shotgun 311 and check if blade 111 fits her eyes, her shotgun, and performs its functions well.

When the shooter holds the shotgun in firing position at eye level (FIG. 5), semi transparent blade 111 is located between his eyes but predominantly into the vision field of cross dominant eye 511. Blade 111 prevents eye 511 from seeing barrel 512 and aiming bead 513, so cross dominant eye 511 can no longer relate shotgun 311 to a target and, thus, lead the shooting process. The gun target relation is now made by the non dominant eye, which has its line of sight along barrel 512 and not beside it.

If blade 111 does not perform all of these functions, the shooter is able to replace it with one of a different size. The different sized blade is verified just like the first. After the shooter finds the blade that fits her, she proceeds in shooting as usual.

To store away shotgun 311 (FIG. 3), the shooter can unmount the device by unfastening screw 120 and sliding base 118 off trigger guard 312. Another option is to unfasten screw 113 and remove blade 111, leaving the rest of the device mounted for quicker future installation.

When used as described above, the device accomplishes several functions:

(1) Allows a cross dominant shooter to shoot effectively from the side of his or her dominant hand
(2) Prevents cross dominant eye 511 (FIG. 5) from leading the shooting process
(3) Allows the shooter to see the moving target with both eyes at all time during the shooting process.

CONCLUSION AND RECOMMENDATIONS

Accordingly, the reader can see that at least one embodiment of the device provides a solution which allows for peripheral and binocular vision when aiming at moving targets. Another advantage is that it can be adjusted to fit the needs of a wide demographic of shooters. Also, the device is easy to attach and detach from the shotgun without leaving permanent marks or requiring expert handling. Most importantly, this device allows shooters with ocular cross dominance to shoot from the side of their dominant hand with both eyes open without causing eyestrain. This helps them correctly aim the shotgun at moving targets, thus improving shooting performance.

Although the description above contains many specificities, these should not be construed as limiting the scope of the embodiment but as merely providing an illustration of one of possible embodiments. For example, the blade can have different shapes, such as semi circular or molded to the shape of the firearm, or colors, such as white, grey, or brown; the base and holder can be one solid piece of a more organic shape and they can be made of plastic; the fastening slits of the base can be clips having their arms hinged at one end, etc.

The scope of the embodiment should be determined by the appended claims and their legal equivalents, rather than by the examples given.

The invention claimed is:

1. A device to be used by a shooter on a shoulder-mounted firearm of the kind having a barrel, a trigger and a trigger guard, the trigger guard being made of a strip of solid material surrounding said trigger, comprising:

a. a base having a pair of arms protruding from a common origin such that said arms sandwich a section of the trigger guard when said device is mounted;

b. fastening means for releasably fixing said pair of arms around said section of the trigger guard; and, c. a support assembly extending upwardly from said base and supporting a screen, whereby said screen protrudes into a sightline of an eye opposite to a shoulder where the shooter mounts said firearm such that said screen obstructs a view of the barrel while permitting said sightline to reach a distant moving target.

* * * * *